US006230993B1

(12) United States Patent
Austin et al.

(10) Patent No.: US 6,230,993 B1
(45) Date of Patent: May 15, 2001

(54) METHOD OF CHARGING USING NONINCENDIVE ROTARY ATOMIZER

(75) Inventors: Ronald M. Austin, Indianapolis; Varce E. Howe, Zionsville, both of IN (US); David R. Huff, Santa Rosa Beach, FL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/483,325

(22) Filed: Jan. 14, 2000

Related U.S. Application Data

(63) Continuation of application No. 09/211,766, filed on Dec. 15, 1998, now Pat. No. 6,076,751.

(51) Int. Cl.[7] ..... B05B 5/04
(52) U.S. Cl. ..... 239/700; 239/703; 239/708
(58) Field of Search ..... 239/700, 701, 239/702, 703, 704, 708, 223, 224, 3

(56) References Cited

U.S. PATENT DOCUMENTS

| | | | | |
|---|---|---|---|---|
| 3,155,539 | | 11/1964 | Juvinall . | |
| 4,148,932 | * | 4/1979 | Tada et al. | 239/700 X |
| 4,171,100 | | 10/1979 | Benedek et al. . | |
| 4,275,838 | * | 6/1981 | Fangmeyer | 239/223 |
| 4,518,119 | * | 5/1985 | Vetter | 239/703 X |
| 4,943,005 | * | 7/1990 | Weinstein | 239/223 |
| 5,433,387 | * | 7/1995 | Howe et al. | 239/703 |
| 5,474,236 | * | 12/1995 | Davis et al. | 239/223 X |
| 5,622,563 | * | 4/1997 | Howe et al. | 239/700 X |
| 5,633,306 | * | 5/1997 | Howe et al. | 239/700 X |
| 5,662,278 | * | 9/1997 | Howe et al. | 239/700 |
| 5,788,165 | * | 8/1998 | Sakakibara et al. | 239/223 X |
| 5,820,036 | * | 10/1998 | Saito | 239/703 |
| 5,865,380 | * | 2/1999 | Kazama et al. | 239/704 |
| 5,947,377 | | 9/1999 | Hansinger et al. . | |
| 6,076,751 | * | 6/2000 | Austin et al. | 239/700 |

OTHER PUBLICATIONS

Approval Standard Factory Mutual Research Corporation, Electrostatic Finishing Equipment Class No. 7260, Mar. 1996.

* cited by examiner

*Primary Examiner*—David A. Scherbel
*Assistant Examiner*—Steven J. Ganey
(74) *Attorney, Agent, or Firm*—Barnes & Thornburg

(57) ABSTRACT

An atomizer for mounting on an output shaft of a motor to be rotated by the motor includes a front surface, a back surface, a coating material cup into which coating material to be atomized by the atomizer is dispensed, and at least one passageway from the cup to the front surface to permit the flow of coating material from the cup to the front surface as the atomizer is rotated. The front surface terminates at a discharge edge from which the coating material is discharged as the atomizer is rotated. The atomizer/shaft comprises an electrically conductive first electrode, an electrically non-conductive portion, and a semiconductive coating provided on the back surface. The semiconductive coating terminates adjacent the edge.

3 Claims, 3 Drawing Sheets

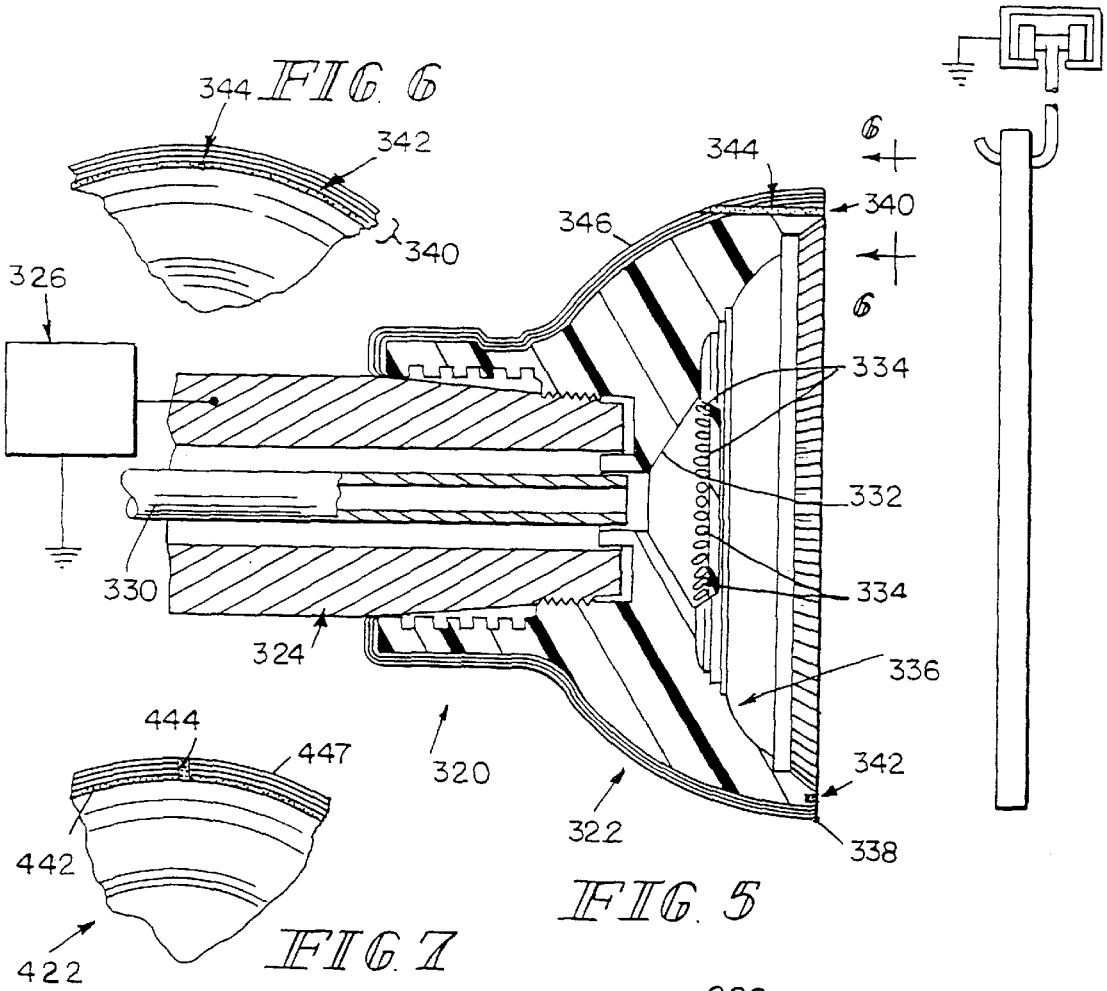
FIG. 6
FIG. 5
FIG. 7
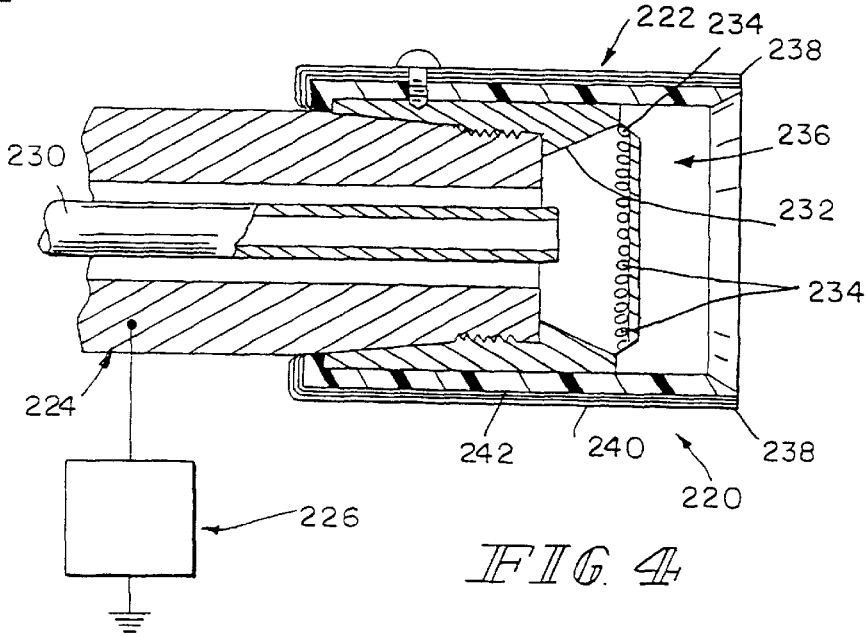
FIG. 4

METHOD OF CHARGING USING NONINCENDIVE ROTARY ATOMIZER

This a continuation application of U.S. Ser. No. 09/211,766, filed Dec. 15, 1998, now U.S. Pat. No. 6,076,751, the disclosure of which is incorporated herein by reference.

BACKGROUND OF THE INVENTION

This invention relates to electrostatically aided atomization and coating of articles with charged particles. It is disclosed in the context of certain types of coating material dispensers. However, it is believed to be useful in a wide range of coating dispensing applications. As used in this application, terms such as "electrically conductive" and "electrically non-insulative" refer to a broad range of conductivities electrically more conductive than materials described as "electrically non-conductive" and "electrically insulative." Terms such as "electrically semiconductive" refer to a broad range of conductivities between electrically conductive and electrically non-conductive.

In its early years, the field of electrostatically aided coating material atomization and dispensing was dominated by the dispensing of coating materials containing organic solvents. These solvents and the coating materials they carried typically were electrically non-conductive or only very slightly conductive, but the carriers or solvents were also relatively volatile. The particles of these coating materials thus could ordinarily be charged by contact with, or at least passage within relatively short distances of, electrodes maintained at relatively high magnitude potentials with respect to the article(s) to be coated by the atomized coating material particles. However, care needed to be taken not to stimulate high energy electrical discharge across the space between the electrodes and the article(s) being coated. This need dictated considerable attention by operators of such equipment. The volatility of these solvents also raised environmental concerns about the release of so-called voc's (volatile organic compounds).

Efforts have continued to enhance solvent based coating systems, both against the hazards associated with having relatively high magnitude electrical potentials across atmospheres containing voc's, and against the inevitable close proximity of operators to the highly charged electrodes of such equipment. Standards for testing such equipment have been promulgated by a number of testing agencies in various countries. Illustrative of such standards is the Electrostatic Finishing Equipment Approval Standard, Class Number 7260, promulgated by Factory Mutual Research Corporation (the FM standard).

The FM standard includes protocols for the testing of both manual equipment (for example, hand held coating atomizing and dispensing guns—the FM standard, chapter 5) and automatic equipment (for example, atomizers mounted on robot arms—the FM standard, chapter 6). Among the tests in both cases is a test in which the equipment at operating voltage is probed using a grounded metal sphere having a diameter of one inch ( about 2.5 cm). This test takes place in an explosive atmosphere of propane in air. An explosion is a failed test. To achieve FM approval, the equipment must, inter alia, pass this test. The FM standard has caused considerable research and improvement in the safety of electrostatic coating systems. Some ways in which the protocols can be addressed are illustrated and described in co-pending U.S. Ser. No. 08/955,039 filed Oct. 21, 1997, titled SAFE CHARGING, and co-pending U.S. Ser. No. 09/046,383 filed Mar. 23, 1997, titled SAFE CHARGING WITH NON-INSULATIVE ATOMIZER, both assigned to the same assignee as this application.

In atomizers constructed generally as described in U.S. Pat. Nos. 5,622,563; 5,633,306; and, 5,662,278, illustrated in FIGS. 1*a–b*, the atomizer 8 is constructed with a relatively well-defined atomizing edge 10. Referring specifically now to FIG. 1*a*, the semiconductive coating 12 applied to the rearward, or outer, surface 14 of the atomizer 8 extends all the way to edge 10, increasing the likelihood of electrical contact between the coating 12 and the coating material 16 being atomized from edge 10. This contact, of course, increases the likelihood that the coating material 16 being atomized from edge 10 will be electrically charged and will be attracted to the article to be coated thereby, all in accordance with known principles.

Referring now particularly to FIG. 1*b*, however, what sometimes happens to atomizer 8 as it is used can be seen. The abrasive nature of some coating materials 16, poor maintenance habits, and other factors can lead to a reduction in the sharpness of edge 10, cause rounding of edge 10, and cause the semiconductive coating 12 to wear away from edge 10. This phenomenon is accelerated somewhat as the edge wears round, owing, it is believed, to the surface tension of the coating material causing the coating material to migrate back along the lip of the atomizer 8 toward the semiconductive coating 12. Because the coating material remains uncharged until it contacts the semiconductive coating 12, there is less tendency for the coating material to leave the lip. As the coating material 16 flows to edge 10 to be atomized, it becomes less likely that the coating material will contact the semiconductive coating 12. It therefore becomes less likely that the coating material will be electrically charged as it is atomized from edge 10. This manifests itself in a reduction in transfer efficiency, the ratio of the amount of coating material being deposited on the article to be coated to the amount of coating material dispensed by the atomizer 8.

SUMMARY OF THE INVENTION

According to a first aspect of the invention, an atomizer is provided for mounting on an output shaft of a motor to be rotated by the motor. The atomizer includes a first, front surface, a second, back surface, a coating material cup into which coating material to be atomized by the atomizer is dispensed, and at least one passageway from the cup to the front surface to permit the flow of coating material from the cup to the front surface as the atomizer is rotated. The front surface terminates at a discharge edge from which the coating material is discharged as the atomizer is rotated. The atomizer further comprises an electrically conductive first electrode, an electrically non-conductive portion, and a semiconductive coating provided on the back surface. The semiconductive coating terminates adjacent the edge.

Illustratively according to this aspect of the invention, the first electrode comprises the cup.

Further illustratively according to this aspect of the invention, the semiconductive coating comprises a multilayer semiconductive coating.

Additionally illustratively according to this aspect of the invention, a terminus of the semiconductive coating adjacent the edge comprises a second electrode.

According to another aspect of the invention, an atomizer is provided for mounting on an output shaft of a motor to be rotated by the motor. The atomizer includes a first, front surface, a second, back surface, a coating material cup into which coating material to be atomized by the atomizer is dispensed, and at least one passageway from the cup to the front surface to permit the flow of coating material from the cup to the front surface as the atomizer is rotated. The front surface terminates at a discharge edge from which the coating material is discharged as the atomizer is rotated. The atomizer further comprises an electrically conductive first electrode, an electrically non-conductive portion, and a semiconductive coating provided on the back surface. The semiconductive coating terminates adjacent the edge. The atomizer further comprises a third surface adjacent the edge, a second electrode provided on the third surface, and at least one electrical pathway between the second electrode and the semiconductive coating.

Illustratively according to this aspect of the invention, the second electrode comprises a groove provided in the third surface and a semiconductive material filling the groove.

Further illustratively according to this aspect of the invention, the groove extends continuously around the entire circumference of the third surface.

Additionally illustratively according to this aspect of the invention, the at least one electrical pathway between the second electrode and the semiconductive coating comprises at least one passageway provided through the electrically non-conductive portion between the third surface and the semiconductive coating, and an electrical conductor provided in the at least one passageway, the electrical conductor terminating adjacent the second electrode and the semiconductive coating.

Alternatively illustratively according to this aspect of the invention, the at least one electrical pathway between the second electrode and the semiconductive coating comprises at least one passageway provided through the electrically non-conductive portion between the second electrode and the semiconductive coating, and a semiconductive material filling the at least one passageway.

Alternatively illustratively according to this aspect of the invention, the at least one electrical pathway between the second electrode and the semiconductive coating comprises at least one slot provided through the electrically non-conductive portion between the second electrode and the semiconductive coating, and a semiconductive material filling the at least one slot.

Further illustratively according to this aspect of the invention, the shaft comprises the first electrode.

BRIEF DESCRIPTION OF THE DRAWINGS

The invention can best be understood by referring to the following detail description and accompanying drawings which illustrate the invention. In the drawings:

FIG. 4 illustrates a sectional side elevational view of another atomizer constructed according to the invention;

FIG. 5 illustrates a sectional side elevational view of another atomizer constructed according to the invention;

FIG. 6 illustrates a fragmentary sectional view, taken generally along section lines 6–6, of the atomizer illustrated in FIG. 5; and, FIG. 7 illustrates a fragmentary sectional view of an alternative construction to the construction illustrated in FIGS. 5–6.

DETAILED DESCRIPTIONS OF ILLUSTRATIVE EMBODIMENTS

Figure 1A:
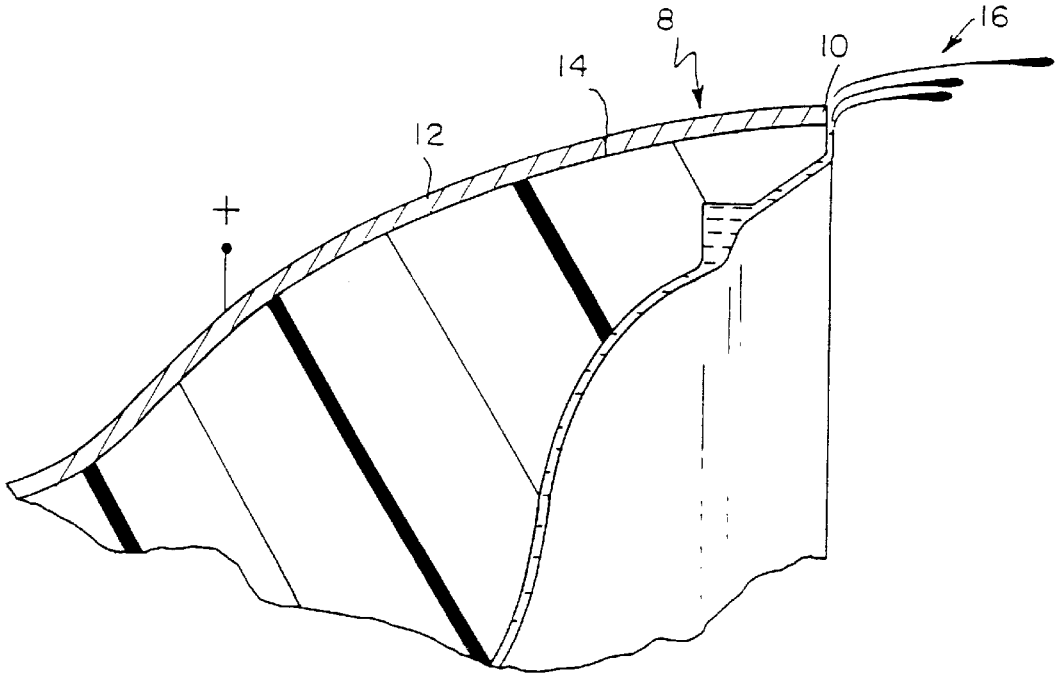
FIGS. 1*a–b* illustrate different fragmentary sectional side elevational view of a prior art atomizer.
Figure 1B:
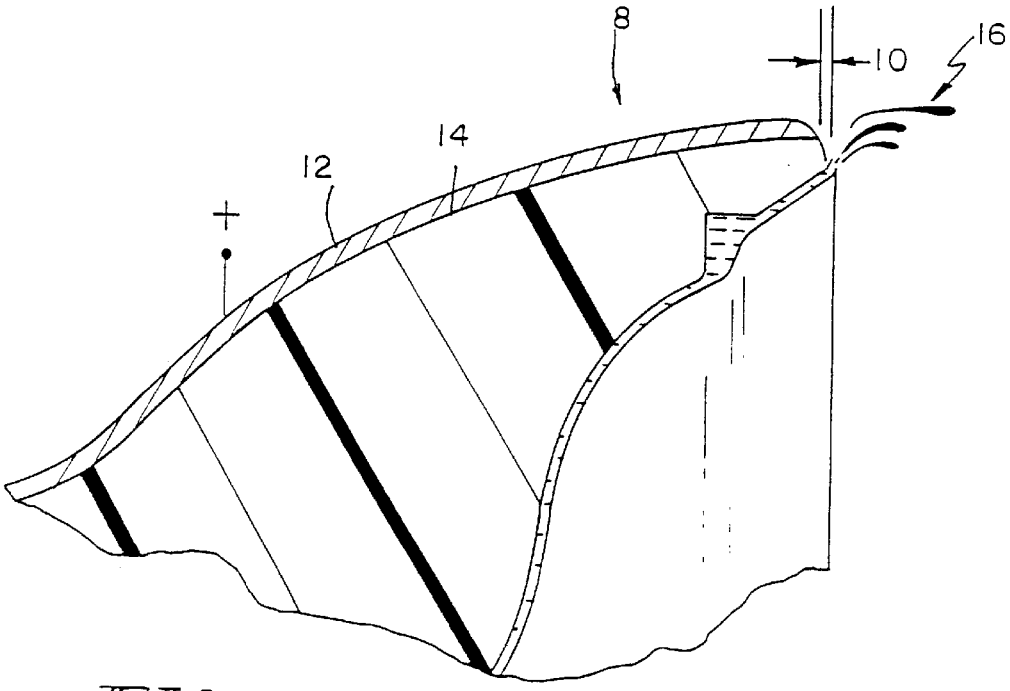
Figure 2:
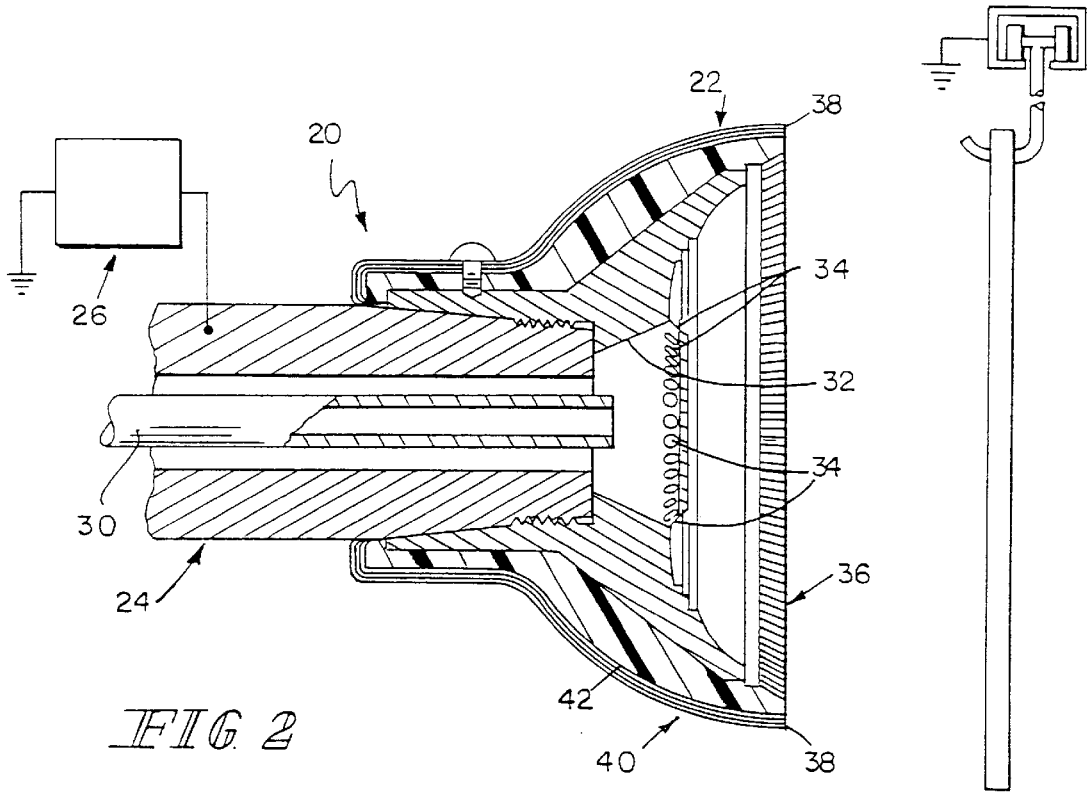
FIG. 2 illustrates a sectional side elevational view of an atomizer constructed according to the invention.

Referring now to FIG. 2, an atomizer head 20 includes a somewhat cup- or bell-shaped atomizer 22 of the general overall shape described in, for example, U.S. Pat. No. 4,148,932. Atomizer 22 is mounted on the output shaft 24 of a motor of the general type described in, for example, U.S. Pat. Nos. 4,275,838; 5,433,387; or, 5,622,563, and is maintained at relatively high-magnitude electrostatic potential by a power supply 26 such as, for example, the Micropak™ power supply available from ITW Ransburg, 1810 North Wayne, Angola, Ind. 46703. The atomizers described herein may be surrounded by shrouds of the general types described in, for example, U.S. Pat. Nos. 3,155,539, 5,433,387 and 5,622,563. Coating material is supplied through a pair feed tube 30 to the metal paint cup 32 of atomizer 22 and flows outward as the atomizer 22 is rotated by motor 24 through passageways 34 provided around the forward perimeter of paint cup 32, and across the somewhat bell-shaped, concave inner surface of atomizer 22 and is atomized from the perimetrally outer edge 38 thereof in accordance with known principles. Except for the metal paint cup 32, atomizer 22 is constructed generally as described in U.S. Pat. Nos. 5,622,563; 5,633,306; and, 5,662,278, from electrically non-conductive filled or unfilled resin with a single- or multiple-layer semiconductive coating 40 on the outside surface 42 thereof.

Figure 3:
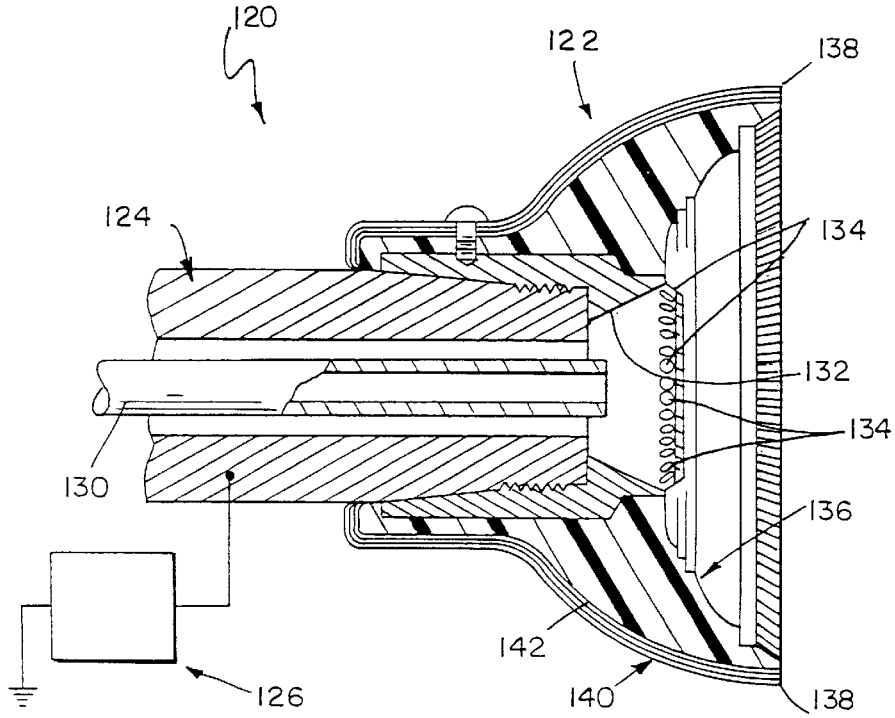
FIG. 3 illustrates a sectional side elevational view of another atomizer constructed according to the invention.

Referring now to FIG. 3, an atomizer head 120 includes a somewhat cup- or bell-shaped atomizer 122 of the general overall shape described in, for example, U.S. Pat. No. 4,148,932. Atomizer 122 is mounted on the output shaft 124 of a motor of the general type described in, for example, U.S. Pat. Nos. 4,275,838; 5,433,387; or, 5,622,563, and is maintained at relatively high-magnitude electrostatic potential by a power supply 126 such as, for example, the Micropak™ power supply. Coating material is supplied through a paint feed tube 130 to the metal paint cup 132 of atomizer 122 and flows outward as the atomizer 122 is rotated by motor 124 through passageways 134 provided around the forward perimeter of paint cup 132, and across the somewhat bell-shaped, concave inner surface 136 of atomizer 122 and is atomized from the perimetrally outer edge 138 thereof. Except for the metal paint cup 132, atomizer 122 is constructed generally as described in U.S. Pat. Nos. 5,622,563; 5,633,306; and, 5,662,278, from electrically non-conductive filled or unfilled resin with a single- or multiple-layer semiconductive coating 140 on the outside surface 142 thereof.

Referring now to FIG. 4, an atomizer head 220 includes a somewhat cup-shaped atomizer 222, the outside of which is generally right circular cylindrical in configuration. Atomizer 222 is mounted on the output shaft 224 of a motor of the general type described in, for example, U.S. Pat. Nos. 4,275,838; 5,433,387; or, 5,622,563, and is maintained at relatively high-magnitude electrostatic potential by a power supply 226 such as, for example, the Micropak™ power supply. Coating material is supplied through a paint feed tube 230 to the metal paint cup 232 of atomizer 222 and flows outward as the atomizer 222 is rotated by motor 224 through passageways 234 provided around the forward perimeter of paint cup 232, and forward along the somewhat cup-shaped, concave inner surface 236 of atomizer 222 and is atomized from the perimetrally outer edge 238 thereof. Except for the metal paint cup 232, atomizer 222 is constructed generally as described in U.S. Pat. Nos. 5,622,563; 5,633,306; and, 5,662,278, from electrically non-conductive filled or unfilled resin with a single- or multiple-layer semiconductive coating 240 on the outside surface 242 thereof.

The embodiments illustrated in FIGS. 2–4 provide another method for charging the coating material besides those disclosed in, for example, U.S. Pat. Nos. 5,622,563; 5,633,306; and, 5,662,278. A charging electrode made of a conductive material, such as the metal paint cups 32, 132, 232 illustrated in FIGS. 2–4 or a conductive resin or the like, is positioned or incorporated as part of the atomizer 22, 122, 222 face design such that the coating material to be dispensed comes into direct contact with this electrode 32, 132, 232 before passing adjacent the atomizer semiconductive coating 40, 140, 240. This results in better charging of the atomized coating material particles, and better transfer efficiency and a cleaner atomizer. This additional electrode 32, 132, 232 is now believed to be the primary charging electrode, similar to the older style, all-metal atomizer designs, and the atomizer semiconductive coating 40, 140, 240 is relied upon mainly to limit the release of energy to an approaching grounded object. The conductive atomizer electrode 32, 132, 232 is constructed so that an approaching grounded object (for example, the probe of the FM standard) will not discharge to it, but rather will continue to discharge to the semiconductive coating 40, 140, 240 at the edge 38, 138, 238 until a critical distance determined according to some standard test (for example, the test mandated by the FM standard) is reached. Given the same potential between the probe and two electrodes 38, 138, 238, 32, 132, 232, the distance at which electrical breakover occurs, and the magnitude of the resulting current, are directly related to the geometries of the two electrodes 38, 138, 238, 32, 132, 232. Current draw is greater and breakover occurs at a greater distance from a sharper electrode 38, 138, 238 than from a blunter or flatter one. The semiconductive coating 40, 140, 240 at the outer edge 38, 138, 238 of the atomizer 22, 122, 222 more closely resembles a sharp edge than the electrically more conductive paint cup 32, 132, 232 which, it must be remembered, is at substantially the same potential. The electrically more conductive paint cup 32, 132, 23 surfaces close to the atomizer edge 38, 138, 238 are given blunter or flatter configurations and recessed further away from the approaching grounded probe than the sharper electrode of the semiconductive coating 40, 140, 240 at edge 38, 138, 238. Therefore as a grounded object, such as the FM standard probe, approaches the atomic a higher electrical field gradient is established between the object and the semiconductive coating 40, 140, 240 at edge 38, 138, 238 than between the object and the paint cup 3 132, 232. Discharge energy is more controlled through the semiconductive coating 40 140, 240 than would be the case of current flow through the conductive paint cup 32, 132, 232. The current through the semiconductive coating 40, 140, 240 increases in inverse proportion to the distance of the approaching grounded object, resulting in less available charge on both the semiconductive coating 40, 140, 240 and the paint cup 32, 132, 232, and a greater voltage drop across the power supply 26, 126, 226 resistance and other resistance(s) which is (are) typically in series between the power supply output terminal and the atomizer 22, 122, 222.

Referring now to FIGS.5–6, an atomizer head 320 includes a somewhat cup- or bell-shaped atomizer 322 of the general overall shape described in, for example, U.S. Pat. No. 4,148,932. Atomizer 322 is mounted on the output shaft 324 of a motor of the general type described in, for example, U.S. Pat. Nos. 4,275,838; 5,433,387; or, 5,622,563, and is maintained at relatively high-magnitude electrostatic potential by a power supply 326 such as, for example, the Micropak™ power supply. Coating material is supplied through a paint feed tube 330 to the paint cup 332 of atomizer 322 and flows outward as the atomizer 322 is rotated by motor 324 through passageways 334 provided around the forward perimeter of paint cup 332, and across the somewhat bell-shaped, concave inner surface 336 of atomizer 322 and is atomized from the perimetrally outer edge 338 thereof Atomizer 322 is constructed generally as described in U.S. Pat. Nos. 5,622,563; 5,633,306; and, 5,662,278. The generally flat forward lip 340 of atomizer 332; is provided with a circumferential groove 342. At one or more, illustratively four circumferentially equally spaced, locations, holes 344 are provided between the bottom, or back wall of groove 342 and the single- or multiple-layer semiconductive coating 346 of the general type described in U.S. Pat. Nos. 5,622,563; 5,633,306; and, 5,662,278 which is applied to atomizer 322. Groove 342 and holes 344 are filled with a semiconductive material, such as, for example, 30 weight percent carbon filled polyetheretherketone (PEEK) or carbon filled, electrically semiconductive epoxy adhesive, such as Emerson & Cuming ECCOBOND 60 L A/B adhesive. Groove 342 can be also filled with, for example, thin wire or a combination of thin wire and semiconductive material, and the connection to the semiconductive coating 346 can be made with thin wire or a combination of thin wire and semiconductive material, inserted into holes 344. Illustratively, groove 342 has a width of about 0.015 inch (about 0.38 mm) and a depth of about 0.020 inch (about 0.51 mm). Illustratively, holes 344 have diameters of about 0.015 inch (about 0.38 mm). In either event, the contact between the material in groove 342 and the semiconductive coating 346 is made through whatever is in the holes 344.

Referring now to FIG. 7, an atomizer 422 is constructed in generally the same way as atomizer 322 illustrated in FIGS. 5–6. In the embodiment illustrated in FIG. 7., however, instead of providing holes 344 to make electrical contact between the semiconductive coating 447 and the material with which groove 442 is filled, a number, illustratively four, of circumferentially equally spaced, radially, axially and circumferentially extending slots 444 are provided. Slots 444 extend between groove 442 and the coating 447. Slots 444 are filled with, for example, the same material as grooves 342, 442 to provide the necessary electrical contact between the material in groove 442 and the semiconductive coating 447. Again, illustratively, groove 442 has a width of about 0.015 inch (about 0.38 mm) and a depth of about 0.020 inch (about 0.51 mm). Illustratively, slots 444 have widths in the circumferential direction of atomizer 422 of about 0.015 inch (about 0.38 mm). The contact between the material in groove 442 and the semiconductive coating 447 is made through whatever is in slots 444.

What is claimed is:

1. An atomizer for mounting on an output shaft of a motor to be rotated by the motor, the atomizer including a first, front surface, a second, back surface, a coating material cup into which coating material to be atomized by the atomizer is dispensed, and at least one passageway from the cup to the front surface to permit the flow of coating material from the cup to the front surface as the atomizer is rotated, the front surface terminating at a discharge edge from which the coating material is discharged as the atomizer is rotated, an electrically conductive first electrode, an electrically non-conductive portion, and a semiconductive coating provided on the back surface, the semiconductive coating terminating adjacent the edge, the first electrode including the cup.

2. The atomizer of claim 1 wherein the semiconductive coating comprises a multilayer semiconductive coating.

3. The atomizer of claim 1 wherein a terminus of the semiconductive coating adjacent the edge comprises a second electrode.

* * * * *